US009702214B2

(12) United States Patent
Turner

(10) Patent No.: US 9,702,214 B2
(45) Date of Patent: Jul. 11, 2017

(54) ABANDONMENT CAP AND METHOD OF SEALING PRODUCTION WELLS

(71) Applicant: Bulldog Services, LLP, Williston, ND (US)

(72) Inventor: Herbert D. Turner, Williston, ND (US)

(73) Assignee: Bulldog Services, LLP, Williston, ND (US)

( * ) Notice: Subject to any disclaimer, the term of this patent is extended or adjusted under 35 U.S.C. 154(b) by 513 days.

(21) Appl. No.: 14/493,521

(22) Filed: Sep. 23, 2014

(65) Prior Publication Data

US 2015/0114670 A1 Apr. 30, 2015

Related U.S. Application Data

(60) Provisional application No. 61/897,968, filed on Oct. 31, 2013.

(51) Int. Cl.
*E21B 33/04* (2006.01)
*E21B 33/13* (2006.01)

(52) U.S. Cl.
CPC ..... *E21B 33/04* (2013.01); *E21B 33/13* (2013.01)

(58) Field of Classification Search
CPC ..... E21B 33/04; E21B 33/13; E21B 33/06; E21B 33/00; E21B 33/03
USPC ..... 166/368, 387, 75.13
See application file for complete search history.

(56) References Cited

U.S. PATENT DOCUMENTS

| | | | | |
|---|---|---|---|---|
| 4,462,464 | A | 7/1984 | Brown et al. | |
| 5,492,373 | A * | 2/1996 | Smith | F16L 23/024 285/12 |
| 5,653,290 | A | 8/1997 | Bland | |
| 6,135,203 | A | 10/2000 | McAnnally | |
| 6,845,815 | B2 | 1/2005 | Hergarden et al. | |
| 7,168,924 | B2 | 1/2007 | Beck et al. | |
| 8,333,237 | B2 | 12/2012 | Duhn et al. | |
| 8,813,853 | B1 * | 8/2014 | Peterson | E21B 33/037 166/351 |
| 2011/0198072 | A1 * | 8/2011 | Cote | E21B 33/03 166/75.11 |

* cited by examiner

*Primary Examiner* — David Bagnell
*Assistant Examiner* — Nikhil Menon
(74) *Attorney, Agent, or Firm* — Marsh Fischmann & Breyfogle LLP; Jonathon A. Szumny

(57) ABSTRACT

A cap for sealing a wellhead assembly of a subterranean well and suspending well assets (e.g., tubing, rods, etc.) therefrom within the well to facilitate production at the well after a period of abandonment. For instance, a decompletion process may be performed on a particular well to be temporarily abandoned which may include disconnecting a pumpjack (e.g., horsehead unit, pumping unit, etc.) from a wellhead of the well, breaking (e.g., disconnecting) the wellhead at the first flange (e.g., closest to ground level) to leave a casing head of the wellhead exposed, and/or the like. Ends of a tubing string and a rod string disposed within the subterranean well may be respectively secured within portions of the disclosed cap. The cap may then be placed and secured over the exposed casing head to limit entry of foreign objects and debris into the well.

22 Claims, 12 Drawing Sheets

ABANDONMENT CAP AND METHOD OF SEALING PRODUCTION WELLS

CROSS-REFERENCE TO RELATED APPLICATION

This application claims priority to U.S. Provisional Application Ser. No. 61/897,968, filed on Oct. 31, 2013, and entitled "WELLHEAD ABANDONMENT CAP," the entirety of which is incorporated herein by reference as if set forth in full.

BACKGROUND

1. Field of the Invention

The present invention generally relates to subterranean wells and, more particularly, to the abandonment of wellheads for subterranean wells.

2. Relevant Background

A subterranean well includes a borehole drilled from surface to an underground formation layer from which oil and/or gas is produced. The well is cased to limit collapse of the borehole. For instance, a well is typically started with a relatively large hole that is cased with a so-called surface casing or conductor which is cemented in the borehole. The well is then continued with a smaller hole drilled to an intermediate depth and cased by an intermediate casing or casing string which extends to the surface. The upper end of the intermediate casing extends concentrically through the conductor and at least part of the intermediate casing is cemented in the borehole. The well is then continued with again a smaller hole drilled to the production zone and cased by production casing or a casing string which extends to the surface. The upper end of the production casing extends concentrically through the intermediate casing and at least part of the production casing is cemented in the borehole.

The upper ends of the intermediate casing and the production casing are suspended from a wellhead assembly which is supported on the surface casing. A conventional wellhead assembly includes a housing supported on the surface casing. The housing is provided with a central bore having internal support shoulders or the like. The wellhead assembly further includes casing hangers for suspending the intermediate casing and production casing from the internal support shoulders in the housing as well as a sealing arrangement for sealing off the annular spaces around the casing hangers.

SUMMARY

The abandonment or temporary abandonment (e.g., hibernation) of a well typically involves, among other tasks, disconnection and removal of most above-ground components of the well such as the pumpjack (or other pumping unit or system), all components of the wellhead above the casing head, and the like. Existing manners of well abandonment include disconnection and removal of most or all of the subterranean well assets from the well such as the rod string, tubing string, and the like. However, doing necessarily requires storage and subsequent reinstallation of the well assets, complicated well inspections, and the like upon resumption of production of the well which increases operator costs, presents scheduling issues, and the like.

In this regard, disclosed herein is a cap for sealing a wellhead assembly of a subterranean well and suspending well assets (e.g., tubing, rods, etc.) therefrom within the well during a period of abandonment. Use of the disclosed cap limits or reduces the need to separately store well assets during the period of abandonment to reduce operator costs and facilitate production at the well after the period of abandonment. For instance, at least a portion of a decomplete process may be performed on a particular well to be temporarily abandoned which may include disconnecting a pumpjack (e.g., horsehead unit, pumping unit, etc.) from a wellhead of the well, breaking (e.g., disconnecting) the wellhead at the first flange (e.g., closest to ground level) to leave a casing head of the wellhead exposed, sending one or more packers down into the well which may be appropriately inflated to seal one or more spaces within the well (e.g., between an outer surface of the tubing and an inner surface of the production casing), sending one or more bridge plugs into the well, and/or the like. Upper ends of a tubing string and a rod string disposed within the subterranean well may be respectively secured within portions of the disclosed cap. The cap may then be placed and secured over the exposed casing head to limit or at least reduce entry of foreign objects and debris into the well. One or more test ports through the cap may be respectively accessed to test the integrity of one or more seals between the cap and an outer surface of a casing stub or mandrel extending from the casing head into the cap, test the integrity of one or more seals between the cap and the casing head, to sample gases and/or liquids within the tubing string, a casing string of the well, and/or the like.

In one aspect, a cap for sealing a production well includes a head including an upper portion, a lower portion, a maximum outer cross-dimension, and a central axis; a flange including an upper portion, an lower portion, a maximum outer cross-dimension, and a central axis, where the upper portion of the flange is adjacent the lower portion of the head, and where the maximum outer cross-dimension of the flange is greater than the maximum outer cross-dimension of the head; and a central opening extending along the central axes of the head and the flange. The central opening includes a first portion within the flange, wherein the first portion of the central opening includes an inner cross-dimension; a second portion adjacent the first portion, where the second portion of the central opening includes an inner cross-dimension, where the inner cross-dimension of the second portion of the central opening is less than the inner cross-dimension of the first portion of the central opening, and where a portion of an inner surface of the head surrounding the second portion of the central opening is threaded; and a third portion adjacent the upper portion of the head, where an inner surface of the head surrounding the third portion is threaded.

In another aspect, a cap for sealing a production well includes a head including an upper portion, a lower portion, a maximum outer cross-dimension, and a central axis; a flange including an upper portion, a lower portion, a maximum outer cross-dimension, and a central axis, where the upper portion of the flange is adjacent the lower portion of the head, and where the maximum outer cross-dimension diameter of the flange is greater than the maximum outer cross-dimension of the head; a central opening extending along the central axes of the head and the flange; and a threaded post secured to the head and extending into the central opening along the central axis of the head. The central opening includes a first portion within the flange, where the first portion of the central opening includes an inner cross-dimension; and a second portion adjacent the first portion. The second portion of the central opening includes an inner cross-dimension, where the inner cross-dimension of the second portion of the central opening is less than the inner cross-dimension of the first portion of the central opening, and where a portion of an inner surface of the head surrounding the second portion of the central opening is threaded.

In another aspect, a method for sealing a production well includes locating an existing casing head of a wellhead assembly of a production well; securing an end of a rod within a central opening of a cap; securing an end of a tubing string within the central opening of the cap; receiving a casing stub of the casing head within the central opening of the cap; and securing a flange of the cap to a flange of the casing head, wherein the rod and tubing string are suspended from the cap within a subterranean well.

DETAILED DESCRIPTION

Figure 1:
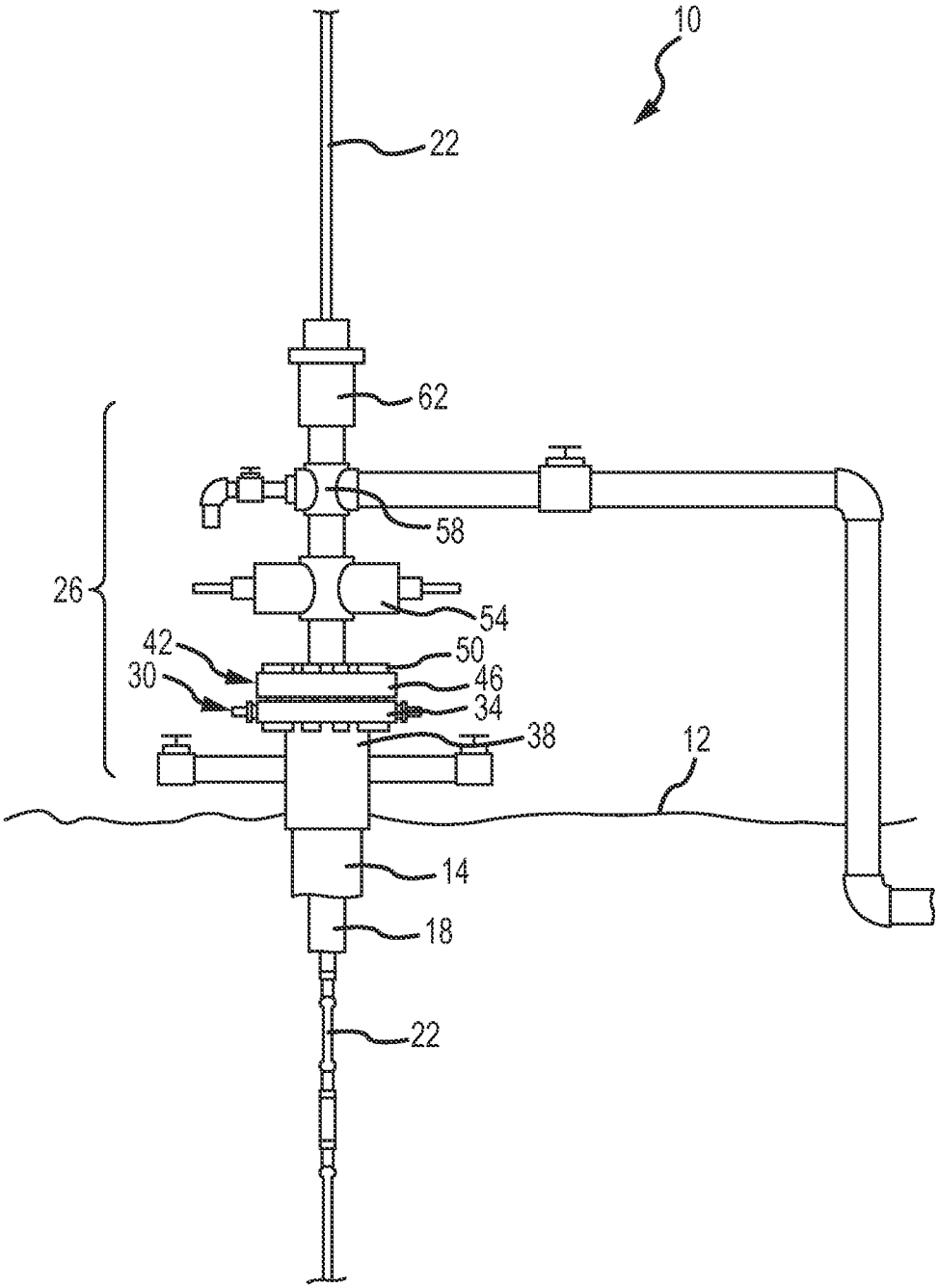
FIG. 1 is simplified elevation view of a pumping system for extracting resources from a subterranean well.

Disclosed herein is a cap for sealing a wellhead assembly of a subterranean well and suspending well assets (e.g., tubing, rods, etc.) therefrom within the well to facilitate production at the well after a period of abandonment. For instance, at least a portion of a decompletion process may be performed on a particular well to be temporarily abandoned which may include disconnecting a pumpjack (e.g., horsehead unit, pumping unit, etc.) from a wellhead of the well, breaking (e.g., disconnecting) the wellhead at the first flange (e.g., closest to ground level) to leave a casing head of the wellhead exposed, sending one or more packers down into the well which may be appropriately inflated to seal one or more spaces within the well (e.g., between an outer surface of the tubing and an inner surface of the production casing), sending one or more bridge plugs into the well, and/or the like. Upper ends of a tubing string and a rod string disposed within the subterranean well may be respectively secured within portions of the disclosed cap. The cap may then be placed and secured over the exposed casing head to limit or at least reduce entry of foreign objects and debris into the well. One or more test ports through the cap may be respectively accessed to test the integrity of one or more seals between the cap and an outer surface of a casing stub or mandrel extending from the casing head into the cap, test the integrity of one or more seals between the cap and the casing head, to sample gases and/or liquids within the tubing string, a casing string of the well, and/or the like.

Use of the cap in the manner disclosed herein facilitates production resumption at the well as many of the well assets are already in place within the well, many previously required and time-consuming well inspections and repairs need not necessarily be performed as a result of the assets remaining within the well, and/or the like. The disclosed cap and related methods of use may be useful in the pad drilling context in which an operator drills only a portion of all wells of a leased drilling pad. After drilling and completing only two of six total wells, for example, an operator may then temporarily abandon the pad with the intent of drilling the remaining four wells a couple years down the road. Previously, the operator would have had to remove most or all of the well assets from the two wells as part of the temporary abandonment of the wells and store the same for later use. Upon resumption of production, the operator would have had to reinstall the well assets, have the well re-inspected, and the like. The presently disclosed cap limits or at least reduces the need to reinstall well assets and re-inspect the well as the cap allows for the well assets to remain in the well and seals the well to limit or at least reduce intrusion of debris and the like into the well. Furthermore, suspending the well assets (e.g., tubing strings, rods, etc.) underground within the well facilitates movement of drilling equipment over the pad to drill any remaining wells of the pad.

Before discussing the disclosed cap in more detail, reference will initially be made to FIG. 1 which presents an elevation view of one embodiment of a system 10 for extracting subterranean resources (e.g., liquids, gases, etc.) within which the disclosed cap may be implemented. After a wellbore (e.g., vertical and/or horizontal) is drilled or otherwise formed in any appropriate manner through the ground surface 12 down to a subterranean reservoir or the like, the wellbore may be completed by cementing a casing string 14 in the wellbore. For instance, the casing string 14 may be made up of a number of successively smaller (e.g., in outer diameter) casing portions (e.g., surface casing, intermediate casing, production casing, etc.) that extend from the ground level down to the production portion of the wellbore adjacent one or more perforations through the casing string 14 into the surrounding earth formation (not shown). A tubing string 18 may be run inside the casing string 14 and through the wellbore down to the production portion of the wellbore.

Furthermore, a rod string 22 may be run through the tubing string 18 and may include a number of parts from an upper end above the ground surface 12 to a lower end adjacent the production portion in the wellbore. Any appropriate downhole pump (not shown) may be implemented within the wellbore to extract resources from a reservoir or the like. In one arrangement, the downhole pump may be a reciprocating type pump having a plunger (not shown) attached to the lower end of the end of the rod string 22 and a pump barrel (not shown) attached to a lower end of the tubing string 18. For instance, fluids (e.g., oil, water, etc.) may flow into the pump barrel and be lifted up through the tubing string 18 to the ground surface 12 on the up stroke of the pump (e.g., via a pumpjack or the like attached to the upper portion of the rod string 22 lifting the rod string 22). The operation of the pump may be controlled so that the fluid level maintained in the pump barrel is sufficient to maintain the lower end of the rod string 22 in the fluid over its entire stroke.

The system 10 also includes any appropriate wellhead 26 at the ground surface 12 of the well for broadly providing the structural and pressure-containing interface for the drilling and production equipment. For instance, the wellhead 26 may include a casing head 30 having a flange 34 and a body 38 extending away from the flange 34, a tubing head 42 including a flange 46 that is secured to the flange 34 of the casing head 30 by a plurality of screws or bolts 50, a blowout preventer (BOP) 54 mounted on the tubing head 42, a flow tee 58 mounted on the BOP 54, a rod stuffing box 62 mounted on the flow tee 58, and/or the like. An upper portion of the casing string 14 (e.g., the production casing) may be appropriately suspended from within the casing head 30 (e.g., by a hanger or the like) while an upper portion of the tubing string 18 may be appropriately suspended from within the tubing head 42 (e.g., by a hanger or the like). The rod string 22 may extend through the wellhead 26 (e.g., through the casing head 30 and tubing head 42) from an upper portion of the rod string 22 down into the wellbore adjacent the bottom of the wellbore. An upper portion of the rod string 22 may be connected to any appropriate system (not shown) operable to reciprocate the rod string 22 upwardly and downwardly, such as a pumpjack and/or other reciprocating pumping unit. It is noted that not all components of the system 10 have been necessarily illustrated and/or discussed in the interest of clarity.

As discussed previously, abandonment or temporary abandonment of a well typically involves, among other tasks, disconnection and removal of most above-ground components of the well such as the pumpjack (or other pumping unit or system), all components of the wellhead 26 above the casing head 30, and the like. Existing manners of well abandonment also include disconnection and removal of most or all of the subterranean well assets from the well such as the rod string 22, tubing string 18, and the like. However, doing necessarily requires storage and subsequent reinstallation of the well assets, complicated well inspections, and the like upon resumption of production of the well which increases operator costs, presents scheduling issues, and the like.

Turning now to FIGS. 2-6, a cap 200 (e.g., cover, crown, etc.) configured to be secured to and sealed over an exposed casing head 130 of a well to be abandoned or temporarily abandoned is presented, where the cap 200 allows for a tubing string 118 and a rod string 122 to be suspended therefrom to retain the same within the well during the period of abandonment. For instance, the casing head 130 may be exposed within a cellar 102 dug beneath a ground level 101 adjacent the well. However, it is to be understood that the disclosed cap 200 may also be utilized with a casing head exposed above the ground level (e.g., casing head 30 of FIG. 1). Broadly, the cap 200 includes a head 204 having an upper portion 208, a lower portion 212 (e.g., opposite to the upper portion 228), an outer diameter 216 (or maximum outer cross-dimension in the case of a head having a non-circular cross-section along a plane that is generally parallel to the ground level 101 when the cap 200 is secured over the casing head 130), and a central axis 220 extending through the head 204. The cap 200 also includes a flange 224 having an upper portion 228, a lower portion 232 (e.g., opposite to the upper portion 228), an outer diameter 236 (or maximum outer cross-dimension in the case of a flange having a non-circular cross-section along a plane that is generally parallel to the ground level 101 when the cap 200 is secured over the casing head 130), and a central axis 240. The upper portion 228 of the flange 224 may be directly connected to and disposed adjacent the lower portion 212 of the head 204. Furthermore, the outer diameter 236 of the flange 224 is greater than the outer diameter 216 of the head 204.

Figure 2:
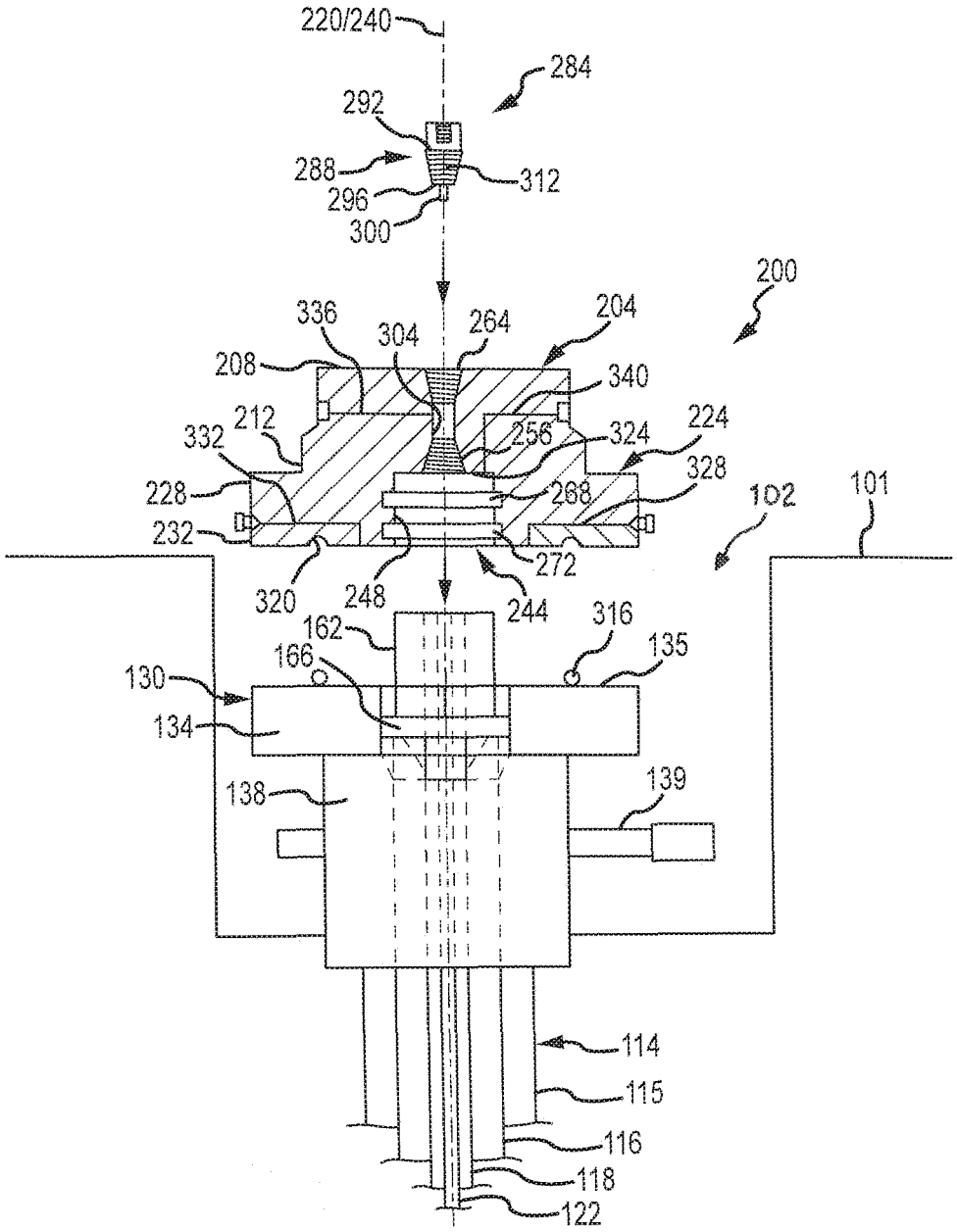
FIG. 2 is an exploded elevation view of an exposed casing head of a wellhead assembly and a cap according to one embodiment for sealing the well and suspending well assets therefrom.
Figure 3:
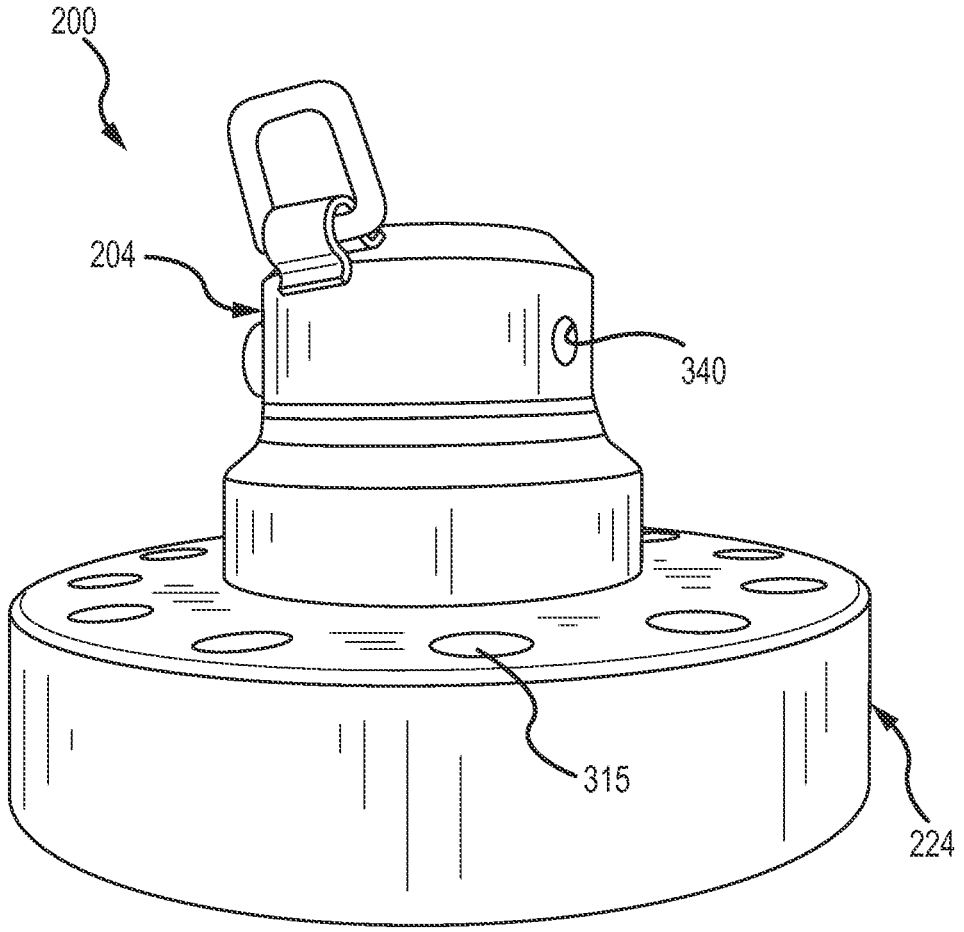
FIG. 3 is an isometric view of the cap of FIG. 2.
Figure 4:
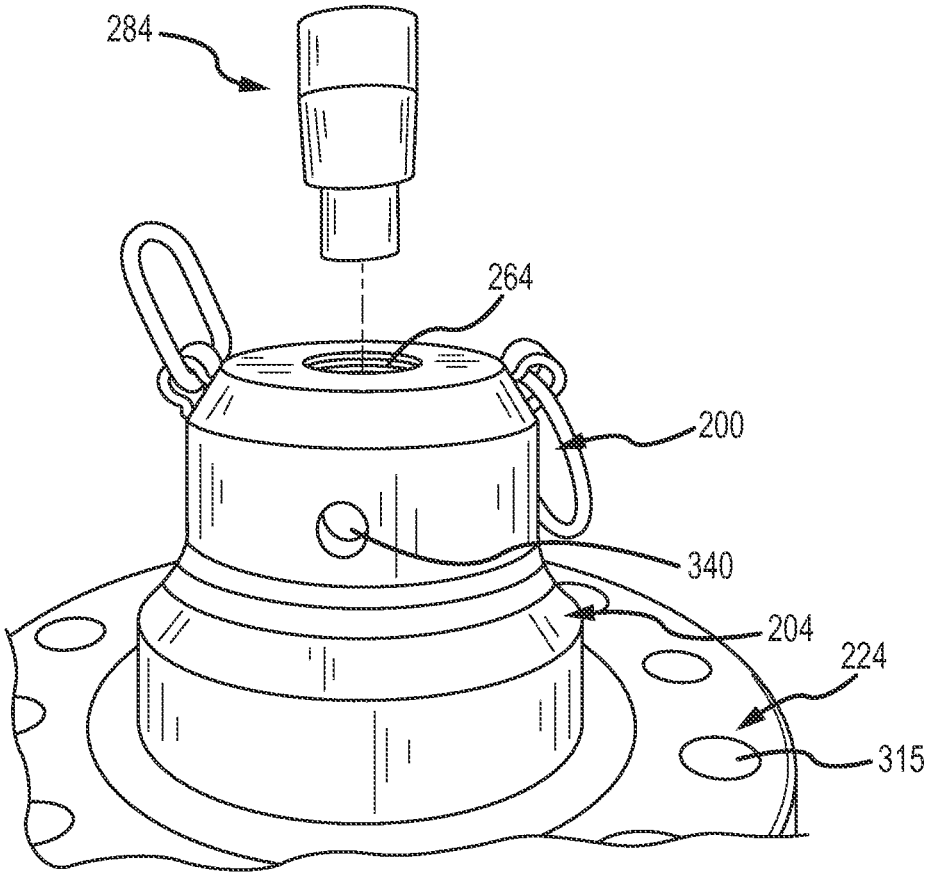
FIG. 4 is another partial isometric view of the cap of FIG. 2 and illustrating a rod connector separated from the cap.
Figure 5:
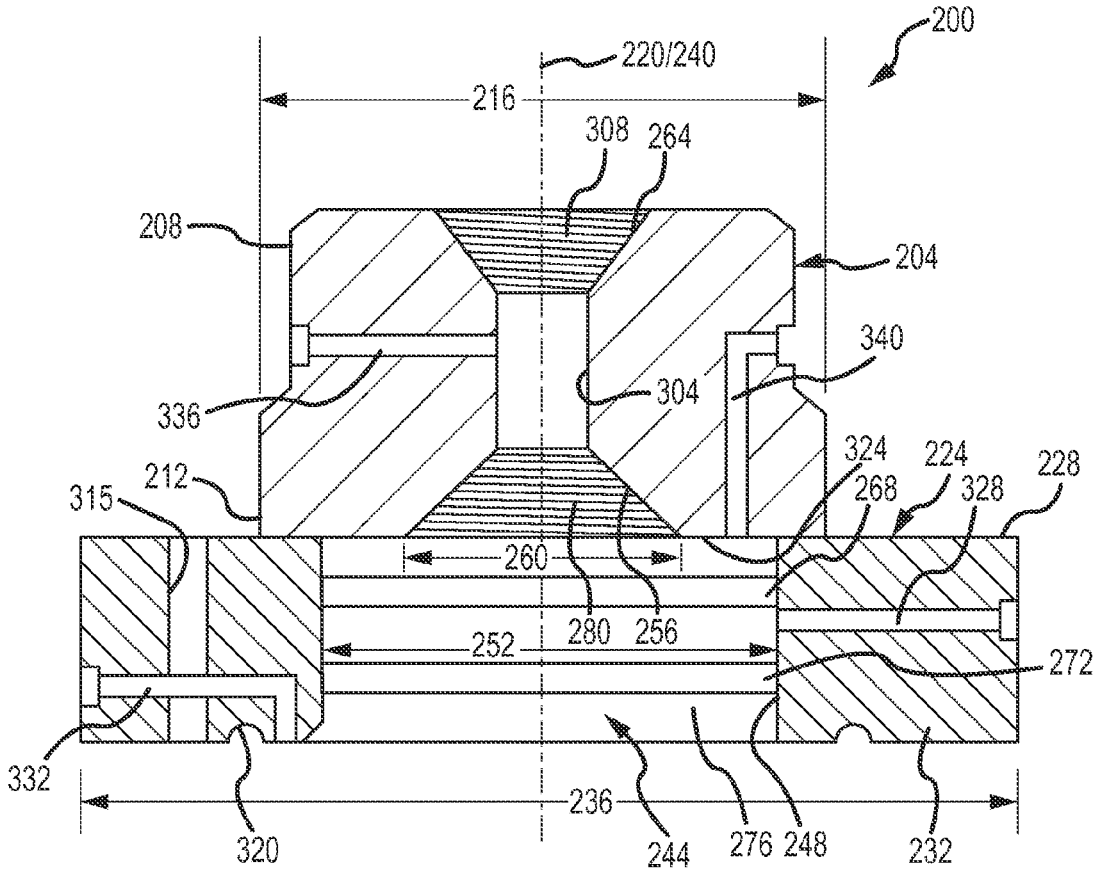
FIG. 5 is a sectional view through the cap of FIG. 2.
Figure 6:
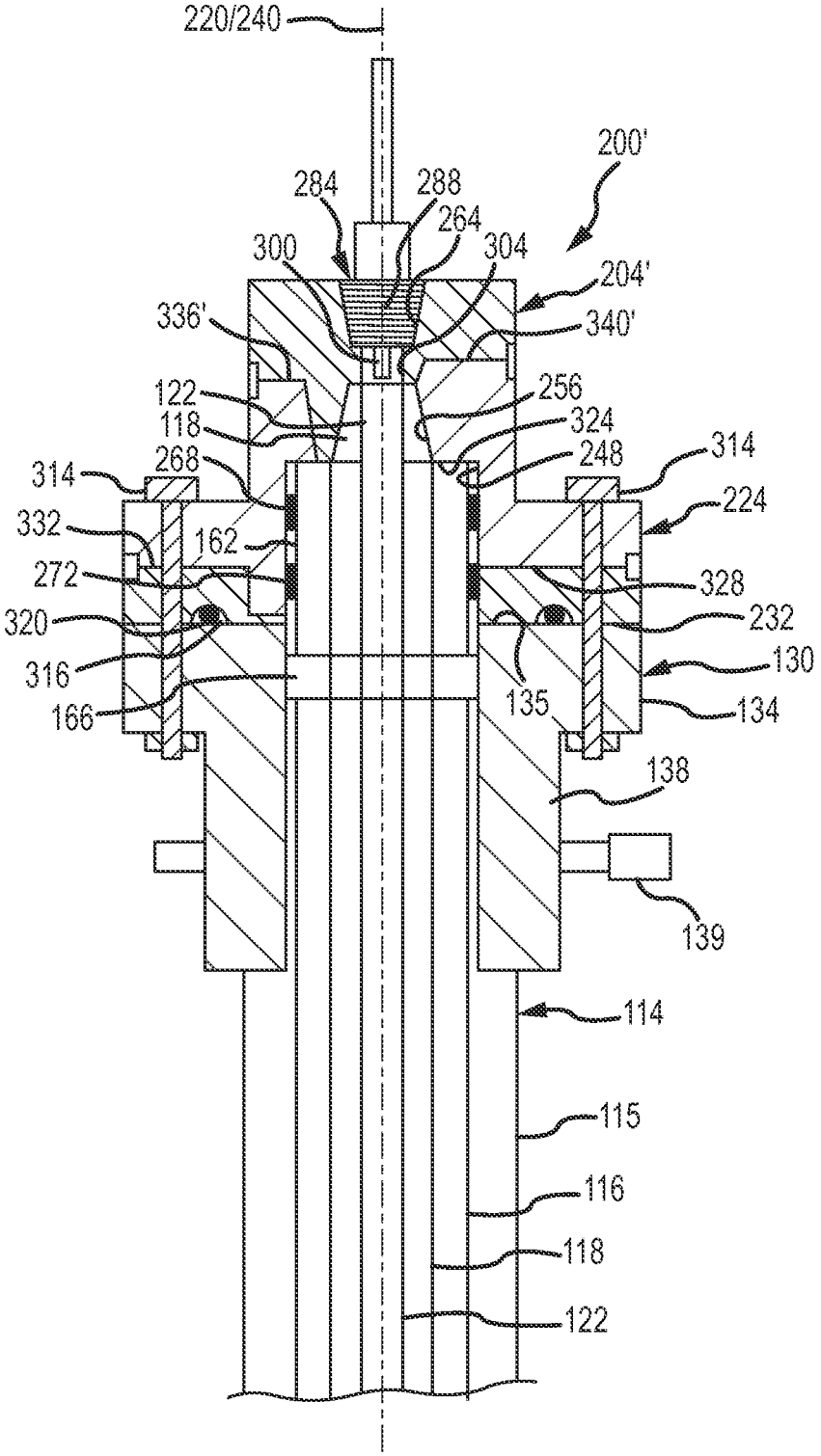
FIG. 6 is an assembled elevation view of the casing head and cap of FIG. 2 according to another embodiment.

As shown in FIGS. 2, 5 and 6, a central opening 244 extends along the central axes 220, 240 of the head 204 and the flange 224 and includes a number of portions that are respectively configured to retain, suspend and/or seal distinct portions of the underground well assets. For instance, the central opening 244 may include a first portion 248 within the flange 224 and that has an inner diameter 252 (or inner cross-dimension) and a second portion 256 adjacent the first portion 248 and/or adjacent the lower portion 212 of the head 204 and that has an inner diameter 260 (or inner cross-dimension) smaller than the inner diameter 252 of the first portion 248. As will be discussed in more detail below, the first portion 248 is configured to receive a casing stub (e.g., tubing stub) 162 or mandrel protruding from the flange 134 of the casing head 130, where the casing stub 162 is connected to a hanger 166 that is configured to appropriately suspend the upper end of the casing string 114 (e.g., production casing 116) therefrom. In one arrangement, the first portion 248 may be configured to receive the upper end of the casing string 114 itself. In another arrangement as shown in the cap 200" of FIG. 9, the first portion 248" of the central opening 244" may include a plurality of successively smaller inner diameters $\mathbf{252}_1$, $\mathbf{252}_2$, $\mathbf{252}_3$ to allow for mating receipt of differently sized casing subs or mandrels.

In any case, one or more seals such as first and second seals 268, 272 (e.g., o-rings or the like) may be respectively secured or otherwise disposed about an inner surface 276 of the flange 224 that surrounds the first portion 248. Upon insertion of the casing stub 162 (e.g., or mandrel or upper end of the casing string 114 itself) into the first portion 248 (e.g., see FIG. 6), contact between the first and second seals 268, 272 and an outer surface of the casing stub 162 may limit or reduce the passage of fluids upwardly or downwardly through the space past the first and second seals 268, 272 (e.g., such as any fluids present in the space between the surface casing 115 and the production casing 116). While shown on the inner surface 276 of the flange 224 that surrounds the first portion 248, the first and second seals 268, 272 (and/or other number of seals) may in other embodiments be disposed on the outer surface of the casing stub 162. In any event, the second portion 256 is configured to receive an upper end of the tubing string 118 for suspension therefrom. In one arrangement, an inner surface 280 of the head 204 surrounding the second portion 256 may be threaded to engage with a correspondingly threaded upper end of the tubing string 118 for suspension of the tubing string 118 therefrom.

The central opening 244 also may also include a third portion 264 adjacent the upper portion 208 of the head 204 that is configured to receive a rod connector 284 (e.g., connection joint, see FIGS. 2 and 6) to which an upper end of the rod string 122 may be secured for suspension of the rod string 122 therefrom. For instance, the rod connector 284 may generally include a body 288 sized for receipt in the third portion and having upper and lower portions 292, 296. The body 288 may include an outer diameter (not labeled) that is greater than the largest inner diameter (or inner cross-dimension) of the third portion 264 to inhibit the body 288 from passing all the way through the third portion 264 towards the second and first portions 256, 248. In one arrangement, a threaded shaft 300 (e.g., post, fastener, etc.)

may be interconnected to and extend away from the lower portion 296 of the body 288. When the body 288 is received in the third portion 264, the shaft 300 may be configured to extend into a fourth portion 304 (or even second or first portions 256, 248) of the central opening 244 between the second and third portions 256, 264 (and that interconnects the second and third portions 256, 264 of the central opening 244), where a central axis of the post 300 extends along and is coincident with the central axis 220, 240. See FIGS. 2, 5 and 6. In another arrangement, the body 288 may additionally include a threaded aperture (not labeled) adjacent the upper portion 292 for threaded interconnection to another rod (e.g. sucker rod).

With reference to FIG. 6, an upper free end of the rod string 122 may include a threaded aperture (not labeled) that is configured to threadingly engage with the threaded shaft 300 to secure the rod string 122 to the rod connector 284. In one arrangement, the suspended weight of the rod string 122 may secure or otherwise hold the body 288 of the rod connector 284 in the third portion 264 of the central aperture 244. Additionally or alternatively, an inner surface 308 (labeled in FIG. 5) of the head 204 surrounding the third portion 264 may be threaded which may be configured to threadingly engage with a correspondingly threaded outer surface 312 of the body 288 to further secure the body 288 within the third portion 264. In some embodiments, different rod connectors 284 having differently sized threaded shafts 300 (e.g., different outer diameters) may be provided to engage with rod strings 122 having differently sized threaded apertures (e.g., different inner diameters) in the ends thereof. In one arrangement, the end of the rod string 122 may include a threaded post extending therefrom that is configured to threadingly engage with a threaded aperture in the second portion 296 of the body 288 of the rod connector 284.

Figure 10A:
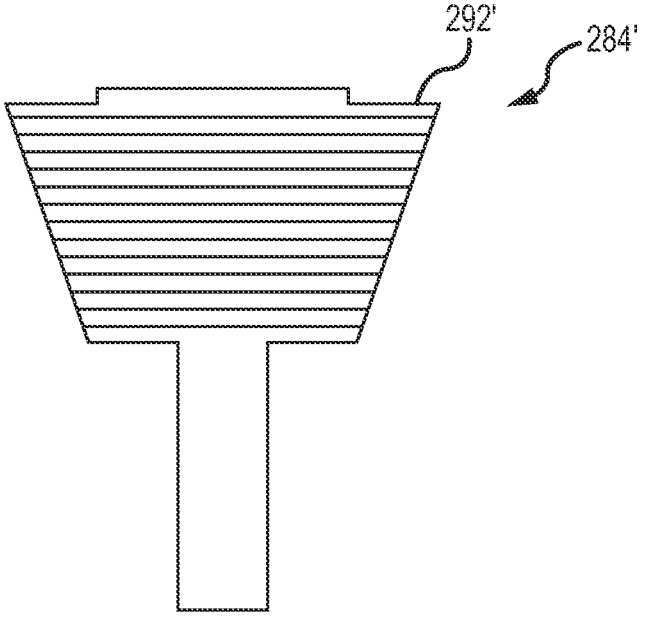
FIG. 10*a* is a side view of a rod connector according to an embodiment.
Figure 10B:
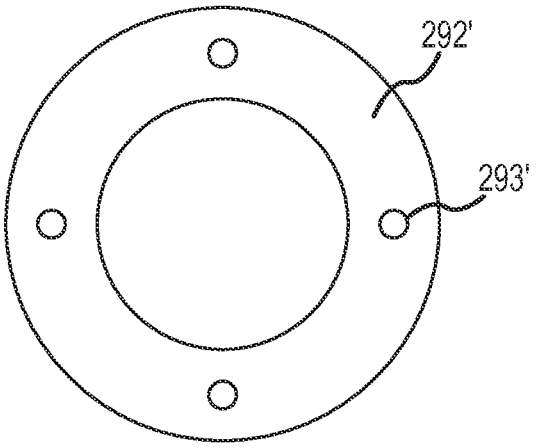
FIG. 10*b* is a plan view of the rod connector of FIG. 10*a*.
Figure 11:
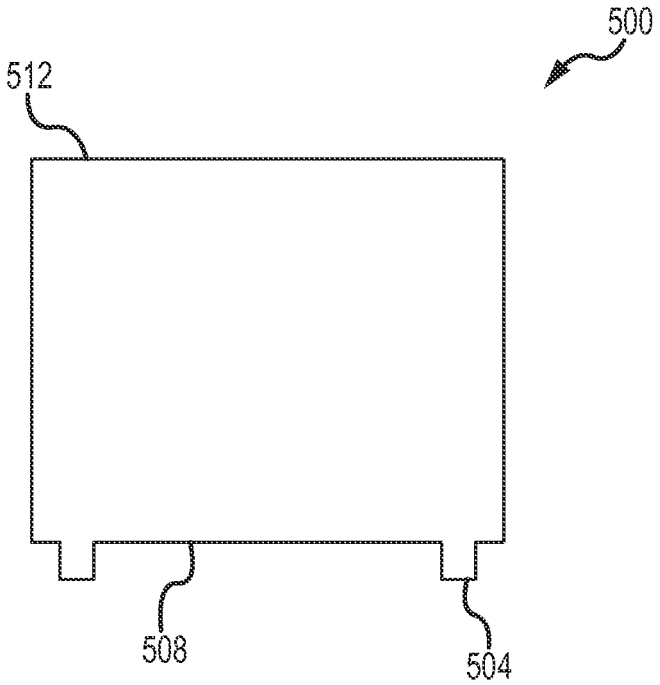
FIG. 11 is side view of a tool disclosed herein.

In one embodiment, the rod connector 284 may be configured to engage with any appropriate tool to facilitate insertion (e.g., threaded insertion) of the rod connector 284 into the third portion 264 of the head 204. For instance, and turning now to the embodiment of the rod connector 284' of FIGS. 10*a*-10*b*, a top portion 292' of the rod connector 284' may include one or more apertures 293' of any appropriate cross-sectional shape (e.g., circular, square, hexagonal) therein that are configured to receive any appropriate tool that may be used to torque the rod connector 284' in one of first and second opposing rotational directions about the central axis 220 to insert/mount or remove the rod connector 284' into or from the third portion 264. With reference to FIG. 11, for instance, a tool 500 may be provided that has two or more protrusions 504 extending therefrom (e.g., from a bottom portion 508 thereof) that are configured to be inserted into or otherwise received in two or more of the apertures 293' of the rod connector 284' (e.g., such as two apertures 293' that are separated by about 180°. After insertion of the protrusions 504 into the apertures 293' the tool 500 may be appropriately torqued (e.g., twisted) in a first or second rotational direction to induce a corresponding rotation of the rod connector 284' and thereby thread or unthread the rod connector 284' into or from the third portion 264.

In one arrangement, the tool 500 may be in the form of a socket that is configured to engage with any appropriate hand tool (e.g., ratchet or the like). For instance, an opposite upper portion 512 of the tool 500 may be of any appropriate shape (e.g., non-circular, such as square, hexagonal, etc.) for engagement with a correspondingly shaped aperture of the hand tool. In this regard, torquing or twisting of the hand tool induces corresponding rotation of the tool 500 and the rod connector 284'. In another arrangement, any appropriate hex wrench (e.g., Allen) may be used to rotate the rod connector 284'. For instance, in the case where at least one of the apertures 293' of the rod connector 284' has a hexagonal cross-section, the hex wrench may be inserted into the single aperture 293' and torqued to rotate the rod connector 284'. While apertures 293' have been shown in the rod connector 284', it is to be understood that other forms of tool engagement features may also be used, such as one or more protrusions that are configured to engage with apertures of a tool, and the like.

Additional manners of securing and thus suspending the rod string 122 from the cap 200 are also envisioned. In one embodiment, the threaded post 300 may be one-piece with the head 204 such that a separate rod connector 284 need not be disposed in the head 204. For instance, the third portion 264 of the central opening 244 may not be provided adjacent the upper portion 208 of the head 204 such that a threaded post 300 extends from an inside of the head 204 (where the third portion 264 was provided) and into the fourth portion 304 and/or second portion 256 for engagement with the end of the rod string 122.

One method for sealing a production well and maintaining well assets (e.g., tubing strings, rod strings, casing strings) within the well will now be disclosed. Initially, an existing casing head of a wellhead assembly of a production well may be located. For instance, an operator may identify the production well associated with the casing head 130 of FIG. 2 as a well to be temporarily abandoned and at least begin a decompletion process (as discussed previously) resulting in exposure of the casing head 130. Use of the disclosed cap 200 may allow for most or all of the well assets to remain in the wellbore after the decompletion process. Specifically, the method may include securing an end of a rod within a central opening of a cap.

For instance, an end of some or all of the rod string 122 disposed in the wellbore may be at least partially pulled out of the casing stub 162 of the casing head 130 and fed into the portion 304 of the central opening 244 via the portions 248, 256 of the central opening 244. It is noted that the use of "first" opening, "second" opening, etc. as used herein is merely to distinguish various portions relative to other portions depending on the particular context in which such terms are used. For instance, while portions 248, 256 were previously referred to as "first" and "second" portions, respectively, the portions 248, 256 may in other contexts be referred to as "second" and "first" portions, respectively.

In any case, the end of the rod string 122 may be secured within the portion 304, such as by inserting the rod connector 284 into the portion 264 and then threadingly engaging a threaded aperture in the end of the rod string 122 with the threaded post 300 of the rod connector 284 (e.g., or in other appropriate manners encompassed herein). See FIG. 6. The method may also include securing an end of a tubing string within a first portion of the cap. For instance, an end of the tubing string 118 may be at least partially pulled out of the casing stub 162 of FIG. 2 and threaded into (e.g., or otherwise secured relative to) the portion 256 of the central opening 244 via the portion 248 of the central opening. See FIG. 6.

Figure 7:
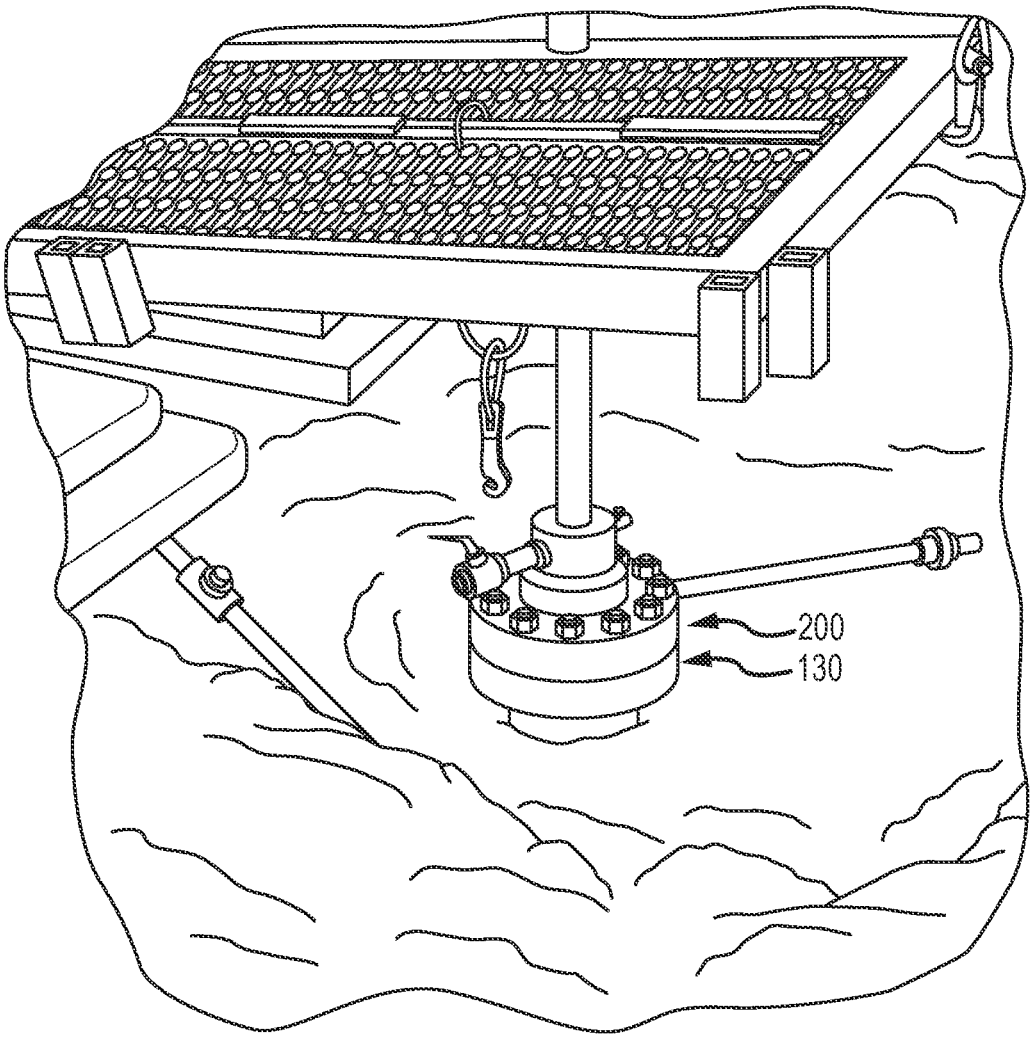
FIG. 7 is an isometric view of the casing head and cap of FIG. 2.
Figure 8:
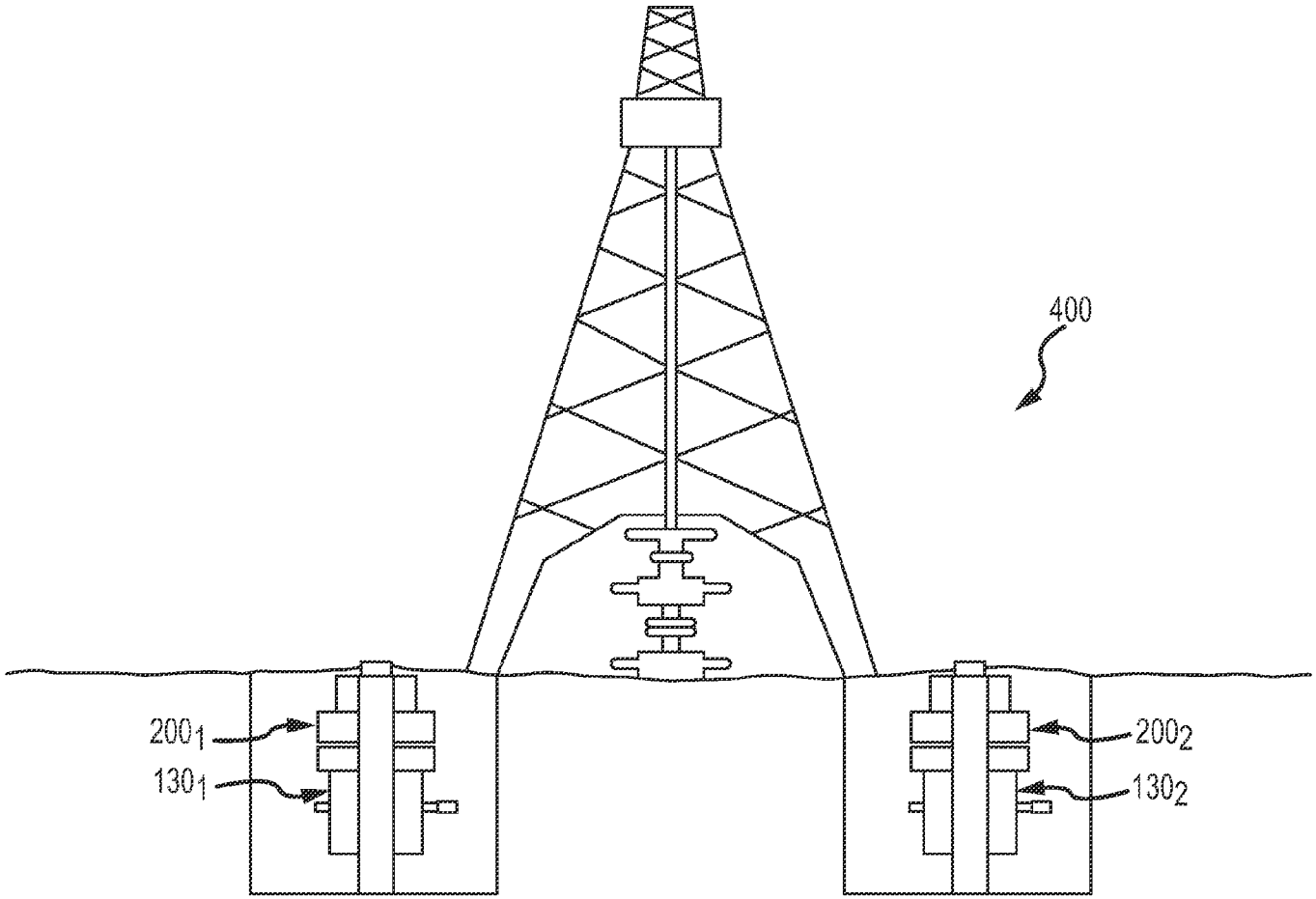
FIG. 8 is a simplified elevation view illustrating one environment in which the disclosed cap may be implemented.

Thereafter, the flange 224 of the cap 200 may be placed over the flange 134 of the casing head 130 such that the casing stub 162 is received in the portion 248 of the central opening 244. The flange 224 of the cap 200 may then be secured in any appropriate manner to the flange 134 of the casing head 130. For instance, a number of fasteners 314 may be inserted through apertures 315 disposed through the upper and lower portions 228, 232 of the flange 224 of the cap 200 as well as through aligned apertures (not shown) through the flange 134 of the casing head 130. FIG. 7 presents a perspective view of the cap 200 being secured over the casing head 130 and FIG. 8 illustrates a drilling pad 400 including first and second wells having respective caps $\mathbf{200}_1$, $\mathbf{200}_2$ secured over corresponding casing heads $\mathbf{130}_1$, $\mathbf{130}_2$. For instance, the respective cellars within which each cap/casing head pair is located may be filled with dirt or the like during the time of abandonment to conceal and protect the pairs of caps and casing heads.

Figure 12A:
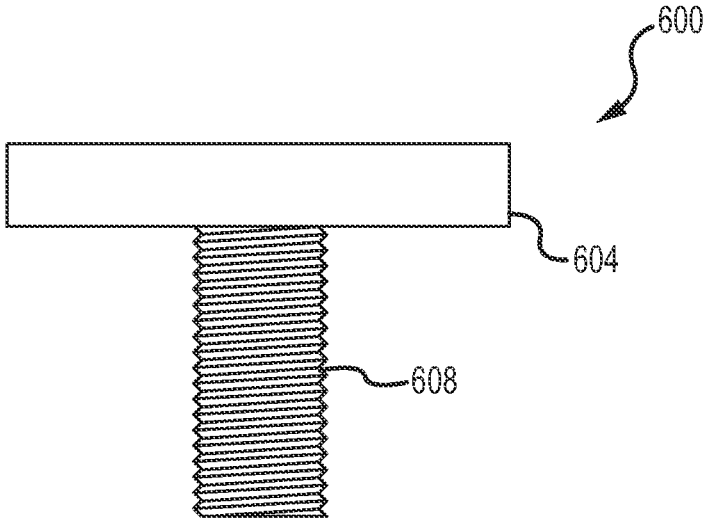
FIG. 12*a* is a side view of a dust cover for use with the cap disclosed herein.
Figure 12B:
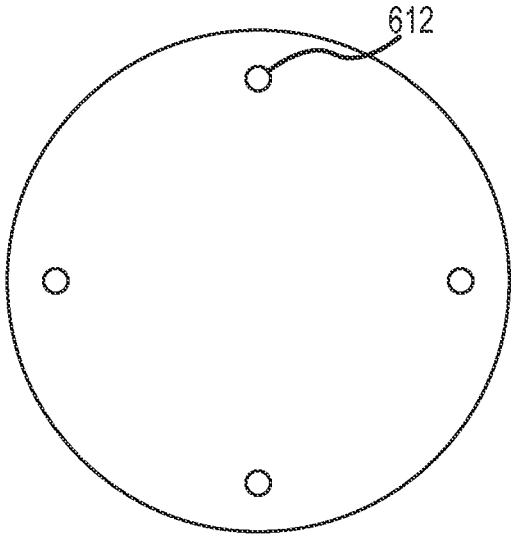
FIG. 12*b* is a plan view of the dust cover of FIG. 12*a*.

In one arrangement, and as shown in FIGS. 12*a*-12*b*, a cover 600 may be appropriately secured over the central opening 244 to limit debris (e.g., dirt, etc.) from falling into the central opening 244 and toward the assets. For instance, the cover 600 may include a head 604 and shaft 608 (e.g., threaded shaft) extending therefrom that is configured to be received in an aperture of the rod connector 284 (e.g., such as non-labeled threaded aperture adjacent top of rod connector 284 of FIG. 2). In this regard, the shaft 608 may be inserted (e.g., threaded) into the aperture of the rod connector 284 to cover the central opening 244. In one arrangement, the head 604 of the cover 600 may include one or more apertures 612 similar to the apertures 293' of the rod connector 284' for engagement with any appropriate tool (e.g., tool 500 of FIG. 11).

At this point, a number of observations may be made. One observation is that various well assets are suspended from either the cap 200 or the casing head 130, the majority of which remain concealed within the wellbore. More specifically, the free end of the rod string 122 is secured within the central opening 244 (e.g., via the rod connector 284) so that the remainder of the rod string 122 is suspended therefrom and extends downwardly through the remainder of the cap 200, the casing head 130, and into the wellbore. See FIG. 6. Also, the upper end of the tubing string 118 is secured within the central opening 244 (e.g., via threaded engagement between the end of the tubing string 118 and the threaded inner surface 280 surrounding the portion 256 of the central opening 244) so that the remainder of the tubing string 118 is suspended therefrom and extends downwardly through the casing head 130 and into the wellbore. Although not shown, some embodiments envision that the shaft 304 extends into the portion 256 of the central opening 244 such that the end of the rod string 122 is disposed within the end of the tubing string 118. In one arrangement, the entire central opening 244 may be of a substantially constant inner diameter (or cross-dimension) such that the body 288 of the rod connector 284 and the upper end of the tubing string 118 may be respectively threaded towards a center of the head 204 until the body 288 and end of the tubing string 118 abut or substantially abut (e.g., where the upper free end of the rod string 122 may be disposed within the upper end of the tubing string 118). In any case, the production casing 116 of the casing string 114 may remain suspended from the hanger 166 of the casing head 130 so that the remainder of the production casing 116 extends into the wellbore.

Another observation is that the lower portion 232 of the flange 224 of the cap 200 may be in direct contact with or at least closely abutting an upper portion 135 of the flange 134 of the casing head 130. In one arrangement, at least one seal 316 (e.g., o-ring) may be disposed on either the lower portion 232 of the flange 224 of the head 204 or the upper portion 135 of the flange 134 of the casing head 130 and configured to engage with a correspondingly shaped groove 320 in the other of the lower portion 232 of the flange 224 of the head 204 or the upper portion 135 of the flange 134 of the casing head 130. This arrangement may limit or at least reduce intrusion of fluids, debris, etc. from the outside of the cap 200 and casing head 130 into a center of the cap 200 and casing head 130, into the casing string 114, and the like (as well as vice versa).

A further observation is that the outer surface of the casing stub 162 may be in contact with the first and second seals 268, 272 within the portion 248 of the central opening 244 of the cap 200 to limit or at least reduce passage of fluids, debris, etc. upwardly or downwardly through the space past the first and second seals 268, 272 (e.g., such as any fluids present in the space between the surface casing 115 and the production casing 116 of the casing string 114). Also, an upper end (not labeled) of the casing stub 1612 may be in contact with and/or abut (or closely abut) a lower wall or surface 324 of the head 204 of the cap 200 that faces the portion 248 of the central opening 244 (e.g., where the lower surface 324 is generally perpendicular to the inner surface 276 of the flange 224 surrounding the portion 248 of the central opening 244). This arrangement advantageously facilitates sampling of fluids within the casing stub 162 and thus the production casing 116 when the cap 200 is secured over the casing head 130 as will be discussed in more detail below.

After the cap 200 has been appropriately secured over the casing head 130 as discussed above, one or more procedures may be performed in one or more manners to test the integrity of one or more of the seals, sample fluids (e.g., liquids, gases) within one or more of the well assets, and/or the like. In one arrangement, at least one port or passage 328 may extend through the flange 224 of the cap 200 from a first end adjacent an outer surface of the cap 200 (e.g., adjacent an outer surface of the flange 224) to a second end (e.g., opposite to the first end) adjacent a space (not labeled) between the first and second seals 268, 272. See FIGS. 2, 5 and 6. For instance, any appropriate air pressure test may be conducted via the passage 328 to test to what degree the first and second seals 268, 272 are sealing the space between the inner surface 276 of the flange 244 that surrounds the first portion 248 and the outer surface of the casing stub 162. Similarly, at least one port or passage 332 may extend through the flange 224 of the cap 200 from a first end adjacent an outer surface of the cap 200 (e.g., adjacent the outer surface of the flange 224) to a second end (e.g., opposite to the first end) adjacent the lower portion 232 of the flange 224 inside of the seal and groove 316, 320 to allow for similar integrity testing of the seal 316. In one embodiment as shown in the cap 200" of FIG. 9, the second end of the passage 328" may also be adjacent the lower portion 232 of the flange 224 inside of the seal and groove 316, 320.

In a further arrangement, at least one port or passage 336 may extend through the head 204 of the cap 200 from a first end adjacent an outer surface of the cap 200 (e.g., an outer surface of the head 204) to a second end (e.g., opposite to the first end) adjacent the fourth portion 304 (or second portion 256) of the central opening and an open end of the tubing string 118 to allow for any appropriate monitoring (e.g., sampling) of fluids, debris, etc. within the tubing string 118. Additionally, at least one port or passage 340 may extend through the head 204 of the cap 200 from a first end adjacent an outer surface of the cap 200 (e.g., an outer surface of the head 204) to a second end (e.g., opposite to the first end) adjacent the lower surface 324 of the head 204 and an open end of the casing stub 162 to allow for any appropriate monitoring (e.g., sampling) of fluids, debris, etc. within the casing stub 162 and thus the production casing 116 of the casing string 114. In one arrangement and as shown in the embodiment of the cap 200' of FIG. 6, the second end of the passage 336' may be adjacent the lower surface 324 of the head 204 and the second end of the passage 340' may be adjacent the second portion 256 of the opening 244. As also shown, the body 138 of the casing head 130 may include one or more ports 139 or the like connected to passages that lead into the surface casing 115 of the casing string 114 for monitoring of fluids and/or debris therein.

Figure 9:
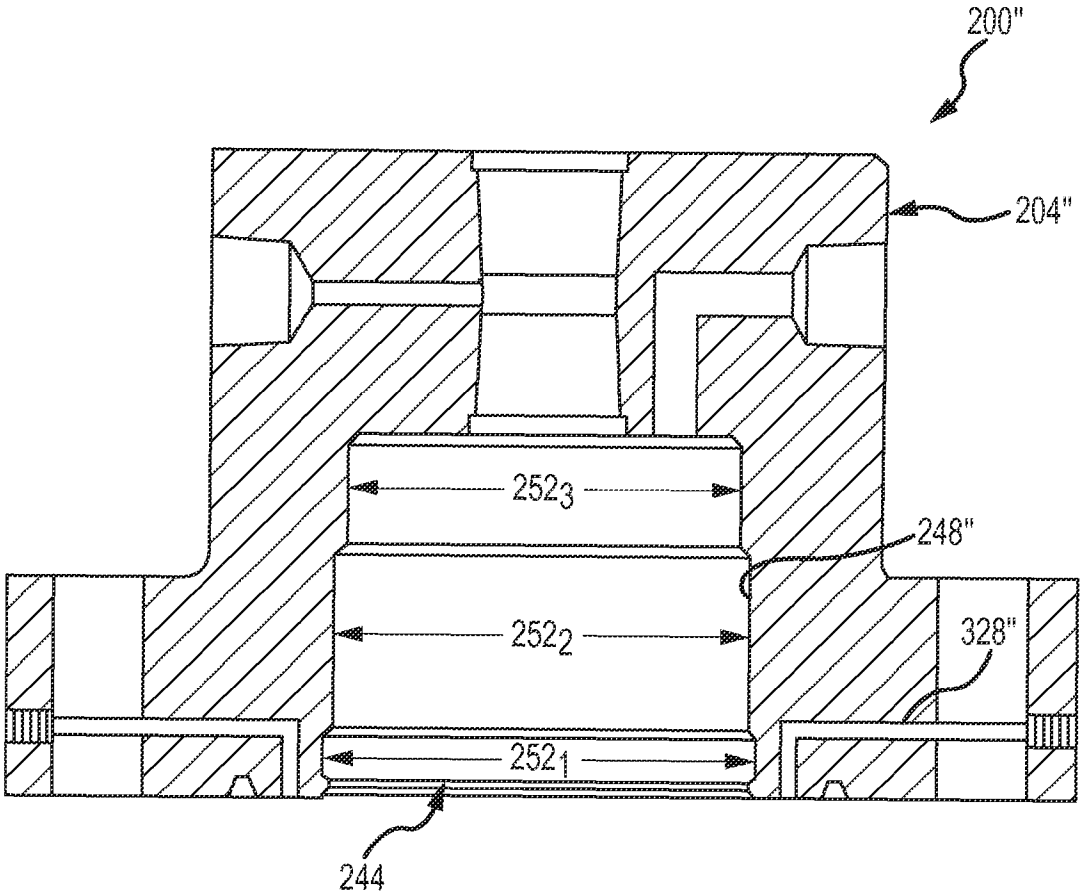
FIG. 9 is a sectional view of a cap according to another embodiment.

The cap 200 may be constructed of any appropriate material(s) and be configured to suspend well assets (e.g., tubing strings 118 and rod strings 122) of any desired weight. As just one example, the cap 200 may be constructed of 41xx (e.g., 4130, 4140, etc.) steel and have a suspension capacity of 120,000 lbs or more. The cap 200 may also have any appropriate dimensions such as a 23" outer diameter, 5K American Petroleum Institute (API) flange and/or the like. In one arrangement, the inner diameter of the portion 248 of the central opening 244 may be about 7" to receive an about 7" casing stub or mandrel. In the arrangement of FIG. 9, for instance, the inner diameters $\mathbf{252}_1$, $\mathbf{252}_2$, $\mathbf{252}_3$ may be about 9.3", 9" and 8.5", respectively, to allow for mating receipt of differently sized casing subs or mandrels. In another arrangement, the inner diameter of the portion 256 of the central opening 244 may having a largest inner diameter of about 2⅞" to receive a similarly sized upper end of a tubing string 118.

It will be readily appreciated that many additions and/or deviations may be made from the specific embodiments disclosed in the specification without departing from the spirit and scope of the invention. For instance, while each of the portions 256, 264 of the central opening 244 are illustrated in FIGS. 2, 5 and 6 as generally tapering in a direction towards a center of the head 204, some arrangements envision that one or both of the portions 256, 264 may be of a constant inner diameter. As another example, although the head 204 of the cap 200 as been illustrated as having a stepped outer surface and thus two or more discrete outer diameters (or maximum outer cross-dimensions), some arrangements envision that the head 204 may have a constant outer diameter. Still further, some arrangements envision that any appropriate dust cover (not shown) may be included that may be appropriately secured over the cap 200 (and in some cases additionally the casing head 130) to limit or at least reduce the entry of fluids, debris, etc. into the cap 200.

Any of the embodiments, arrangements, or the like discussed herein may be used (either alone or in combination with other embodiments, arrangement, or the like) with any of the disclosed aspects. Merely introducing a feature in accordance with commonly accepted antecedent basis practice does not limit the corresponding feature to the singular. Any failure to use phrases such as "at least one" does not limit the corresponding feature to the singular. Use of the phrase "at least generally," "at least partially," "substantially" or the like in relation to a particular feature encompasses the corresponding characteristic and insubstantial variations thereof. Furthermore, a reference of a feature in conjunction with the phrase "in one embodiment" does not limit the use of the feature to a single embodiment. Still further, any use of "first," "second," "third," etc. herein does not necessarily connote any specific order or arrangement of components and/or processes disclosed herein and has merely be used to facilitate understanding of the teachings presented herein.

While this specification contains many specifics, these should not be construed as limitations on the scope of the disclosure or of what may be claimed, but rather as descriptions of features specific to particular embodiments of the disclosure. Furthermore, certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations, one or more features from a claimed combination can in some cases be excised from the combination, and the claimed combination may be directed to a subcombination or variation of a subcombination.

Similarly, while operations may be depicted in the drawings in a particular order, this should not be understood as requiring that such operations be performed in the particular order shown or in sequential order, or that all illustrated operations be performed, to achieve desirable results. In certain circumstances, multitasking and/or parallel processing may be advantageous. Moreover, the separation of various system components in the embodiments described above should not be understood as requiring such separation in all embodiments, and it should be understood that the described program components and systems can generally be integrated together in a single software and/or hardware product or packaged into multiple software and/or hardware products.

The above described embodiments including the preferred embodiment and the best mode of the invention known to the inventor at the time of filing are given by illustrative examples only.

What is claimed is:

1. A cap for sealing a production well, comprising:

a head including an upper portion, a lower portion, a maximum outer cross-dimension, and a central axis;

a flange including an upper portion, a lower portion, a maximum outer cross-dimension, and a central axis, wherein the upper portion of the flange is adjacent the lower portion of the head, and wherein the maximum outer cross-dimension of the flange is greater than the maximum outer cross-dimension of the head; and a central opening extending along the central axes of the head and the flange, wherein the central opening includes:

a first portion within the flange, wherein the first portion of the central opening includes an inner cross-dimension;

a second portion adjacent the first portion, wherein the second portion of the central opening includes an inner cross-dimension, wherein the inner cross-dimension of the second portion of the central opening is less than the inner cross-dimension of the first portion of the central opening, and wherein a portion of an inner surface of the head surrounding the second portion of the central opening is threaded; and a third portion adjacent the upper portion of the head, wherein an inner surface of the head surrounding the third portion is threaded.

2. The cap of claim 1, wherein the head comprises a lower surface on the lower portion of the head, wherein the lower surface of the head faces the first portion of the central passage within the flange.

3. The cap of claim 2, wherein the lower surface of the head is substantially perpendicular to the inner surface of the flange.

4. The cap of claim 2, further comprising:

a passage extending through the head, wherein the passage includes a first end adjacent an outer surface of the head and a second end adjacent the lower surface of the head.

5. The cap of claim 1, further comprising:

a passage extending through the head, wherein the passage includes a first end adjacent an outer surface of the head and a second end adjacent the inner surface of the head.

6. The cap of claim 5, wherein the second end of the passage that is adjacent the inner surface of the head is between the second and third portions of the central opening.

7. The cap of claim 1, wherein at least one of the second and third portions of the central passage tapers in a direction towards a center of the head.

8. The cap of any of claim 1, wherein the central opening further comprises:

a fourth portion between the second and third portions of the central opening.

9. The cap of claim 8, where a portion of the inner surface of the head surrounding the fourth portion has a constant inner cross-dimension.

10. A system, comprising:

a casing head secured relative to the ground, wherein the casing head comprises a flange and a body extending away from the flange; and the cap of claim 1 secured to the casing head.

11. The system of claim 10, wherein the flange of the cap abuts the flange of the casing head.

12. The system of claim 10, further comprising:

a tubular stub extending away from the flange of the casing head, wherein the tubular stub is received in the first portion of the central opening of the cap.

13. The system of claim 12, wherein the head of the cap comprises a lower surface on the lower portion of the head, wherein the lower surface of the head faces the first portion of the central passage within the flange, and wherein an end of the tubular stub abuts the lower surface of the head.

14. The system of claim 12, further comprising:

a tubing string extending through the tubular stub, wherein an end of the tubing string is received in the second portion of the central opening of the cap.

15. The system of claim 14, further comprising:

a rod extending through the tubing string, wherein an end of the rod is received in a fourth portion of the central opening, wherein the fourth portion of the central opening is disposed between the second and third portions of the central opening.

16. The system of claim 15, wherein the rod and tubing string are suspended from the cap within a subterranean well.

17. The system of claim 15, further comprising:

a connection joint threadably received in the third portion of the central passage, wherein the connection joint is secured to the end of the rod.

18. The system of claim 17, wherein the connection joint comprises:

a body received in the third portion of the central passage; and a shaft extending way from the body, wherein the shaft is received in the fourth portion of the central opening.

19. The system of claim 18, wherein the shaft is threadably connected to the end of the rod.

20. A method of sealing a production well, comprising:

securing the cap of claim 1 to an existing casing head of a production well.

21. A cap for sealing a production well, comprising:

a head including an upper portion, a lower portion, a maximum outer cross-dimension, and a central axis;

a flange including an upper portion, a lower portion, a maximum outer cross-dimension, and a central axis, wherein the upper portion of the flange is adjacent the lower portion of the head, and wherein the maximum outer cross-dimension diameter of the flange is greater than the maximum outer cross-dimension of the head;

a central opening extending along the central axes of the head and the flange, wherein the central opening includes:

a first portion within the flange, wherein the first portion of the central opening includes an inner cross-dimension; and a second portion adjacent the first portion, wherein the second portion of the central opening includes an inner cross-dimension, wherein the inner cross-dimension of the second portion of the central opening is less than the inner cross-dimension of the first portion of the central opening, and wherein a portion of an inner surface of the head surrounding the second portion of the central opening is threaded; and a threaded post secured to the head and extending into the central opening along the central axis of the head.

22. The cap of claim 21, further comprising:

at least a first seal extending along an inner surface of the flange within the first portion of the central opening;

at least a second seal extending along the inner surface of the flange within the first portion of the central opening, wherein the second seal is spaced from the first seal; and a passage extending through the flange, wherein the passage includes a first end adjacent an outer surface of the flange and a second end adjacent the inner surface of the flange, wherein the second end of the passage is between the first and second seals.

* * * * *